United States Patent [19]

Miller et al.

[11] 4,309,888

[45] Jan. 12, 1982

[54] APPARATUS FOR FORMING A CONTAINER PAN

[75] Inventors: Roland E. Miller, Orangeville; Joseph A. Scaletta, Mount Prospect; John Valek, Cicero, all of Ill.

[73] Assignee: Kraftco Corporation, Glenview, Ill.

[21] Appl. No.: 44,979

[22] Filed: Jun. 4, 1979

Related U.S. Application Data

[62] Division of Ser. No. 707,821, Jul. 22, 1976, Pat. No. 4,185,488.

[51] Int. Cl.[3] ..... B21D 28/00

[52] U.S. Cl. ..... 72/334; 72/349; 72/350

[58] Field of Search ..... 72/347, 349, 350, 351, 72/360, 334; 113/1 G, 16, 18 R, 18 A, 120 R, 120 G, 120 H, 120 B, 120 QA

[56] References Cited

U.S. PATENT DOCUMENTS

| | | | |
|---|---|---|---|
| 2,294,451 | 9/1942 | Ernst | 72/351 X |
| 3,147,723 | 8/1964 | Williamson | 72/350 X |
| 3,147,724 | 9/1964 | O'Brien et al. | 72/350 |
| 3,163,142 | 12/1964 | Buhrke | 72/356 |
| 3,344,646 | 10/1967 | Moller | 72/350 X |
| 3,421,466 | 1/1969 | Hess | 113/120 B |
| 3,435,653 | 4/1969 | Scoletta et al. | 72/336 |
| 3,668,914 | 6/1972 | Vyacheslanovich | 72/350 |
| 3,733,881 | 5/1973 | Grigorenko | 72/349 |
| 3,774,561 | 11/1973 | Herbold | 113/120 B |
| 3,918,377 | 11/1975 | Herbold | 113/120 B |

*Primary Examiner*—Leon Gilden

*Attorney, Agent, or Firm*—Fitch, Even, Tabin, Flannery & Welsh

[57] ABSTRACT

A method and apparatus are disclosed for forming a drawn container pan having planar side walls and smooth curved corner walls the upper edges of which are formed with an outwardly directed peripheral stacker ledge and an upstanding rim, and wherein the pan is formed by drawing the peripheral edge of a blank between clamping surfaces under selected pressure differential at the portions of the blank forming the side and corner walls of the pan. A method and apparatus are also disclosed for trimming the drawn pan and forming stacking protuberances adjacent the corners of the pan.

7 Claims, 16 Drawing Figures

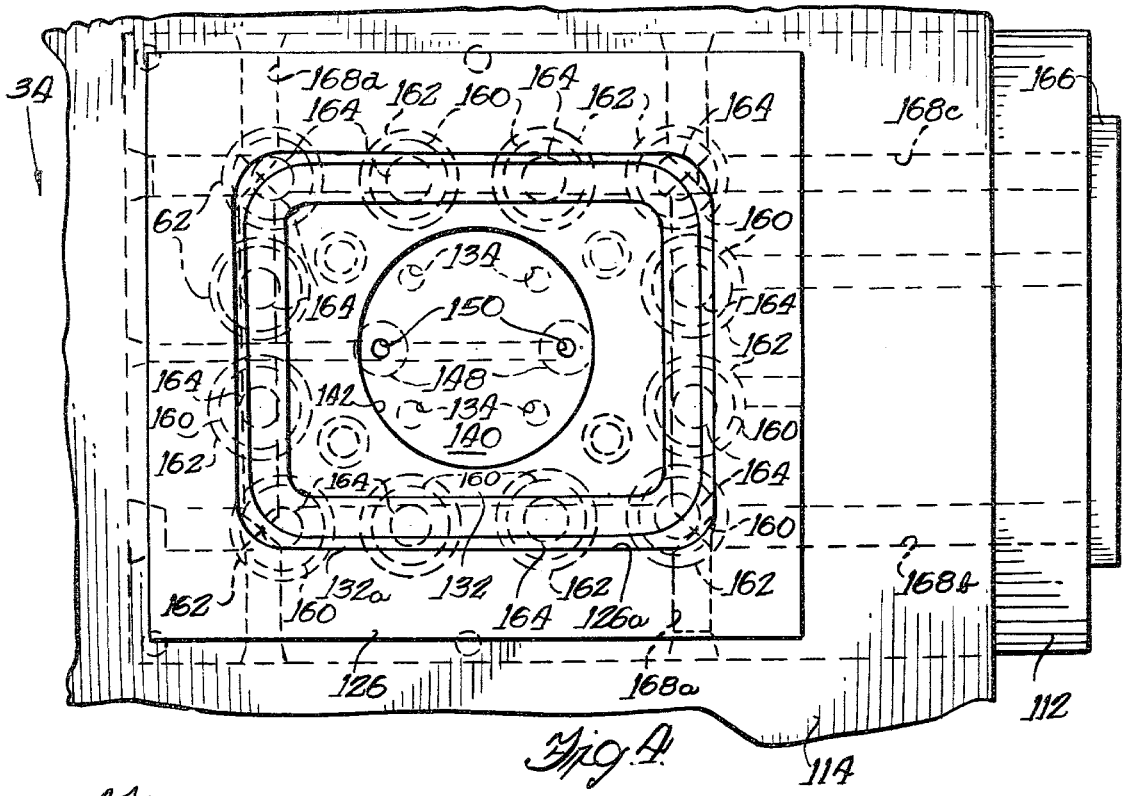
Fig. 4.
Fig. 6.
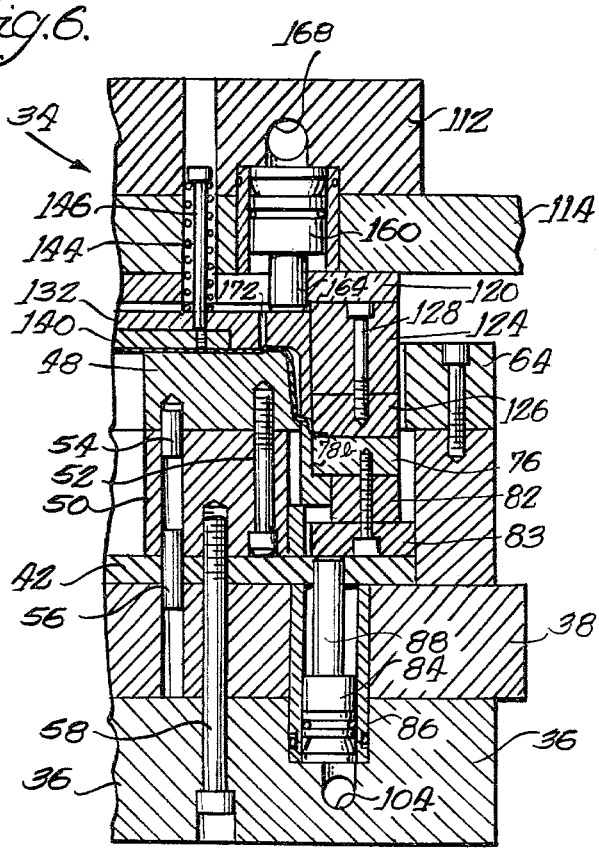
Fig. 6a.
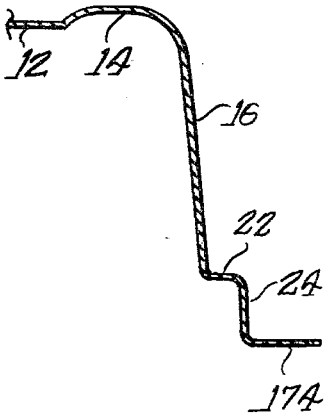

APPARATUS FOR FORMING A CONTAINER PAN

This is a division of application Ser. No. 707,821, filed July 22, 1976, now U.S. Pat. No. 4,185,488.

The present invention relates generally to containers particularly adapted for food products and the like, and more particularly to a novel apparatus for forming a rectangular pan portion of a container wherein the pan has planar upstanding side walls interconnected by smooth radial corner walls devoid of wrinkles, ripples or other undulations which inhibit easy removal of food products therefrom.

Recent advances in the food packaging industry, and in particular, food processing for institutional use, has resulted in the introduction of pan type containers of generally rectangular configuration. The pan portions of these containers have substantially greater length and width than depth and, when containing a food product and having a lid secured thereon, facilitate retorting of the food product and serving the food product directly from the opened pan while disposed on a steam table or the like.

Because of the highly competitive nature of the food packaging industry, it is important that the pan type containers be made in a high speed economical manner, using a minimal amount of material yet assuring that each container have optimum structural integrity and be capable of maintaining the packaged food products in a fluid-tight condition. The structural integrity must insure that the food container will not rupture or become unsealed when subjected to internal or external pressures as may be encountered during processing and handling. An additional highly desirable feature of such containers is that they facilitate easy and complete removal of the food products therefrom with conventional serving utensils.

It is known to make pan type containers from a relatively thin metal foil wherein the corners of the formed pan are intentionally formed into folds or wrinkles extending in the vertical direction of the corner wall for the purpose of accommodating the excessive material in the corner areas and increasing the strength of the corner walls. See, for example, U.S. Pat. No. 3,336,729, dated Aug. 22, 1967. Such container pans made from metal foil exemplify the types of containers which are not capable of being made into hermetic sealed containers by either double seaming or heat sealing a lid thereon, and do not exhibit high structural integrity and impact characteristics sufficient to prevent fracture, bursting and seam failure. Such metal foil container pans further create corner areas which are inaccessible by conventional serving utensils so that either excessive time is required to totally remove the food product from the corner areas or the food is wasted.

In accordance with the present invention, an apparatus is provided for forming a rectangularly shaped pan portion of a food container having high structural integrity and exhibiting the desired rigidity but having sufficient flexibility to withstand internal and external pressures during processing and use without fracture or seam separation with resultant economic losses.

The apparatus of the present invention is adapted to form a drawn rectangular container pan from a metallic blank, wherein the blank is first drawn to form upstanding planar side walls interconnected through smooth radial corner walls, the blank being thereafter further drawn to form an upstanding rim peripherally of the outer edge of a shelf extending outwardly from the upper edge of the side and corner walls.

In carrying out the present invention, apparatus is provided which includes means for forming a blank of material into a drawn rectangular pan configuration having planar side walls and smooth radially curved corner walls, means for clamping the peripheral edges of the blank during a first draw wherein the side and corner walls are formed, and means for controlling the clamping pressure on the edges of the blank during drawing so that a different clamping pressure is applied to the portions of the blank which form the corner walls than the clamping pressure applied to the portions of the blank which form the side walls of the pan, the clamping pressure on the blank adjacent the drawn corner walls being substantially reduced during a second draw which forms an upstanding rim peripherally of an outwardly directed stacking shelf, whereby smooth radial corner walls are formed free of wrinkles, ripples and the like. Apparatus is also provided for trimming the pan and forming stacking protuberances at the corners of the pan to facilitate denesting.

Further objects and advantages of the present invention, together with the organization and manner of operation thereof, will become apparent from the following detailed description of the invention when taken in conjunction with the accompanying drawings wherein like reference numerals designate like elements throughout the several views, and wherein:

FIG. 4 is a partial plan view of the upper half of the die set of FIG. 2, looking upwardly from the bottom thereof;

Figure 2:
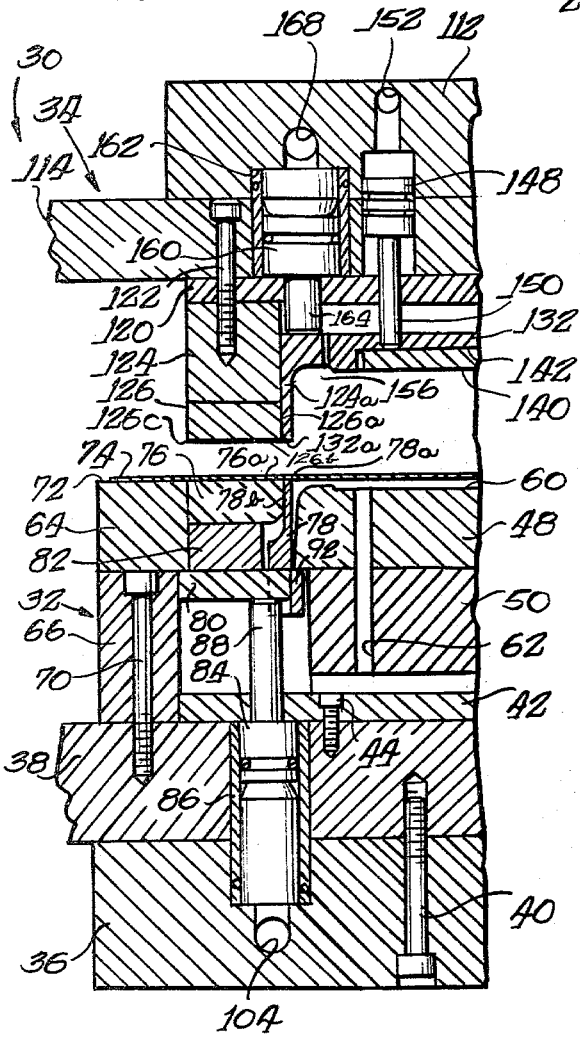
FIG. 2 is a partial transverse sectional view of a die set in accordance with the present invention for forming an untrimmed container pan as shown in FIG. 11.
Figure 5:
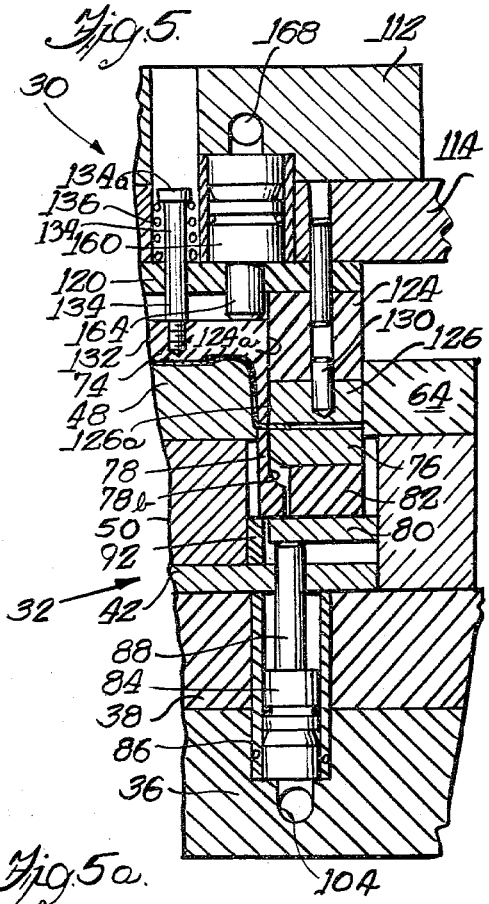
FIG. 5 is a partial transverse sectional view similar to FIG. 2 but showing the various die set elements after a first draw step in forming the untrimmed container pan of FIG. 11.
Figure 5A:
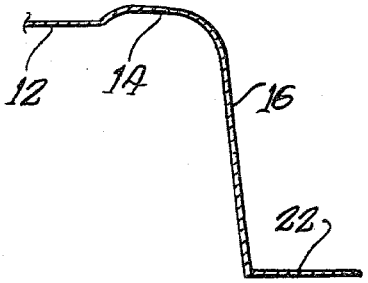
Figure 3:
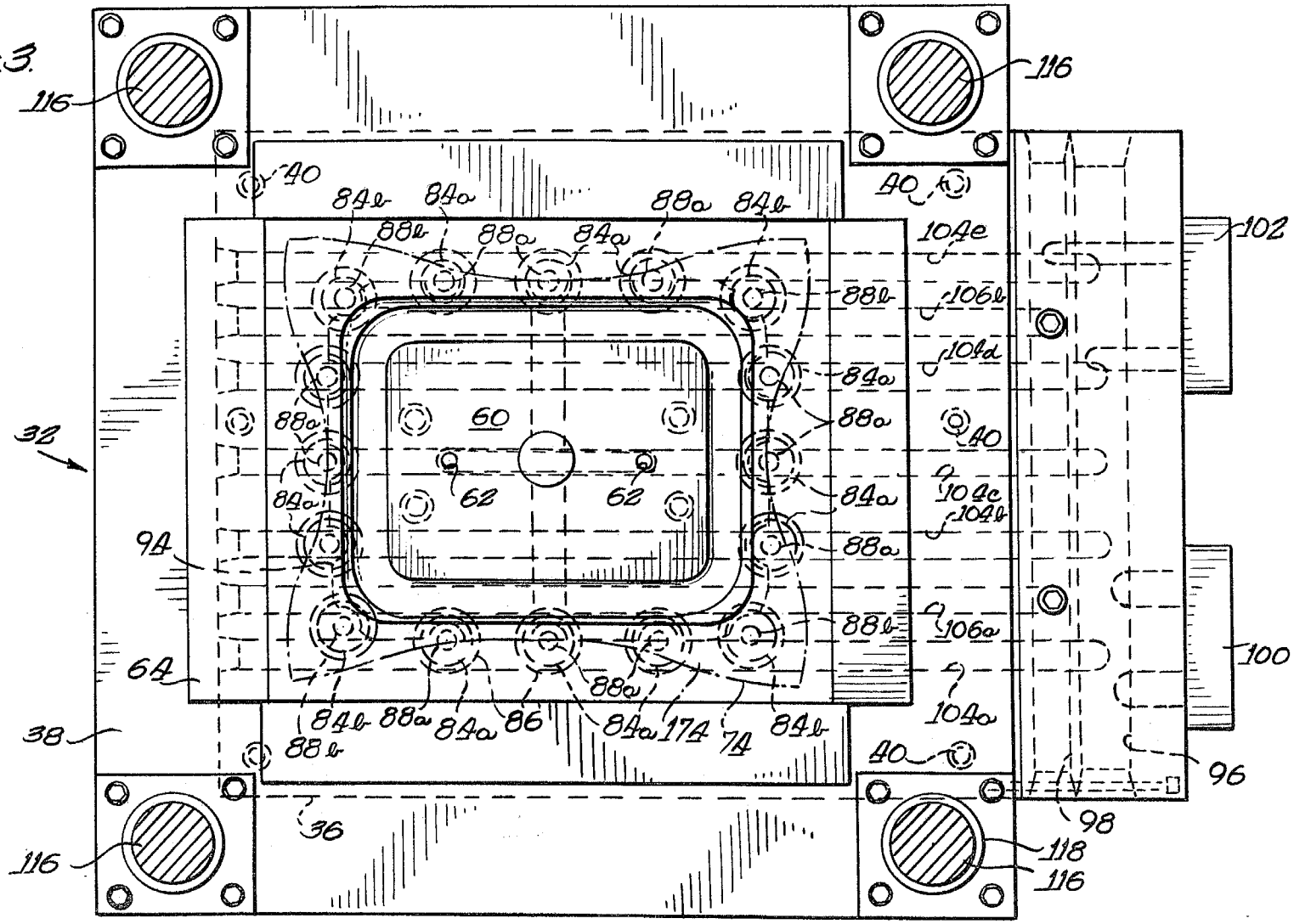
FIG. 3 is a plan view of the lower half of the die set partially illustrated in FIG. 2, an outline of the formed untrimmed container pan being shown in outline in phantom.
Figure 7:
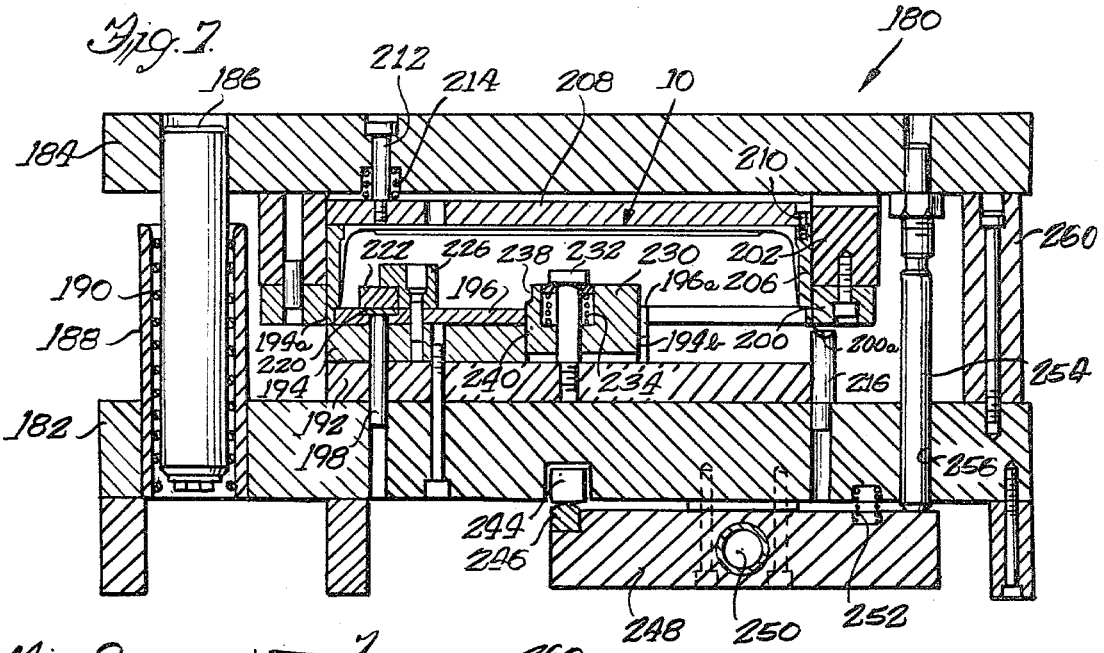
Figure 8:
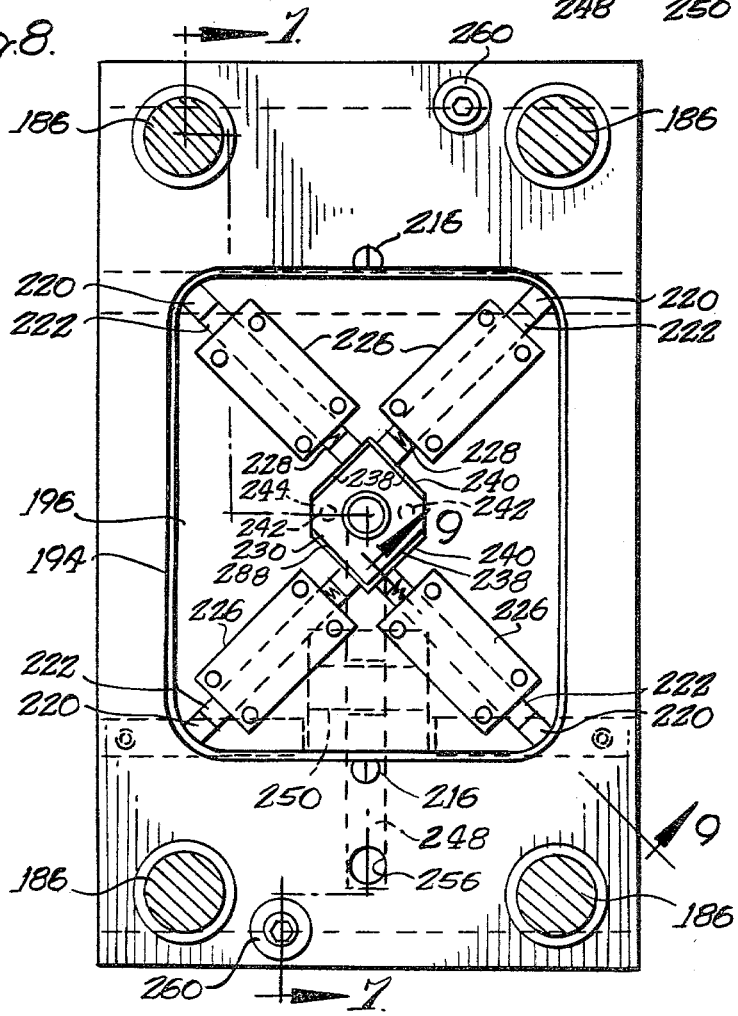
Figure 7A:
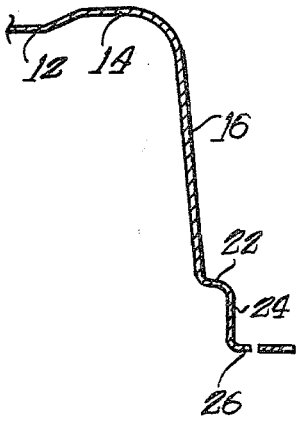
Figure 9:
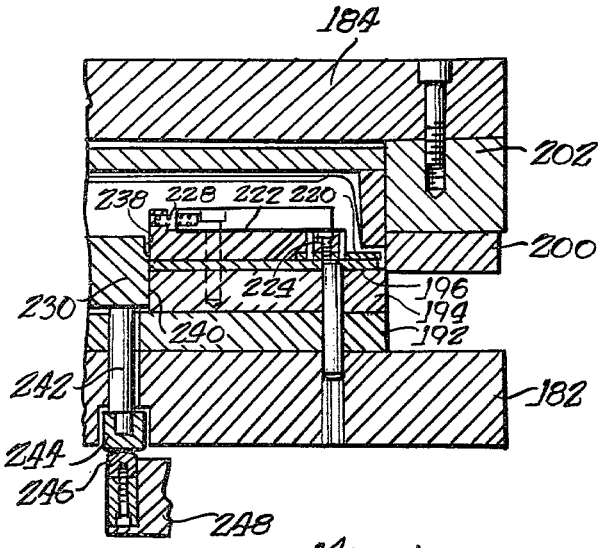
Figure 9A:
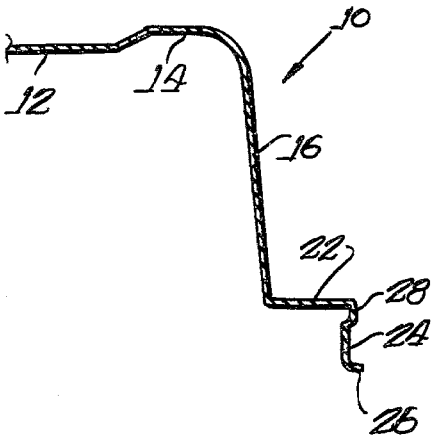
Figure 10:
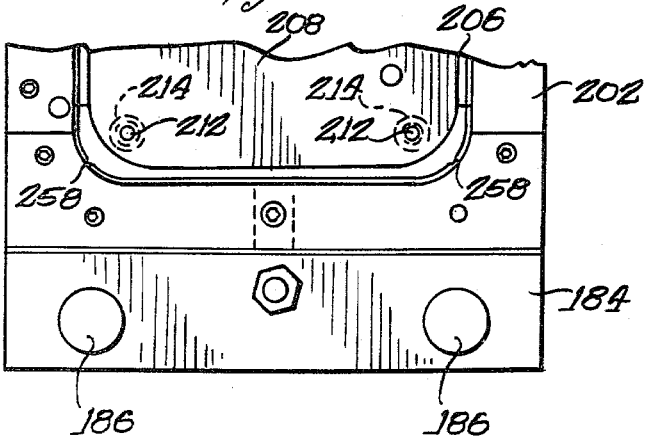
Figure 11:
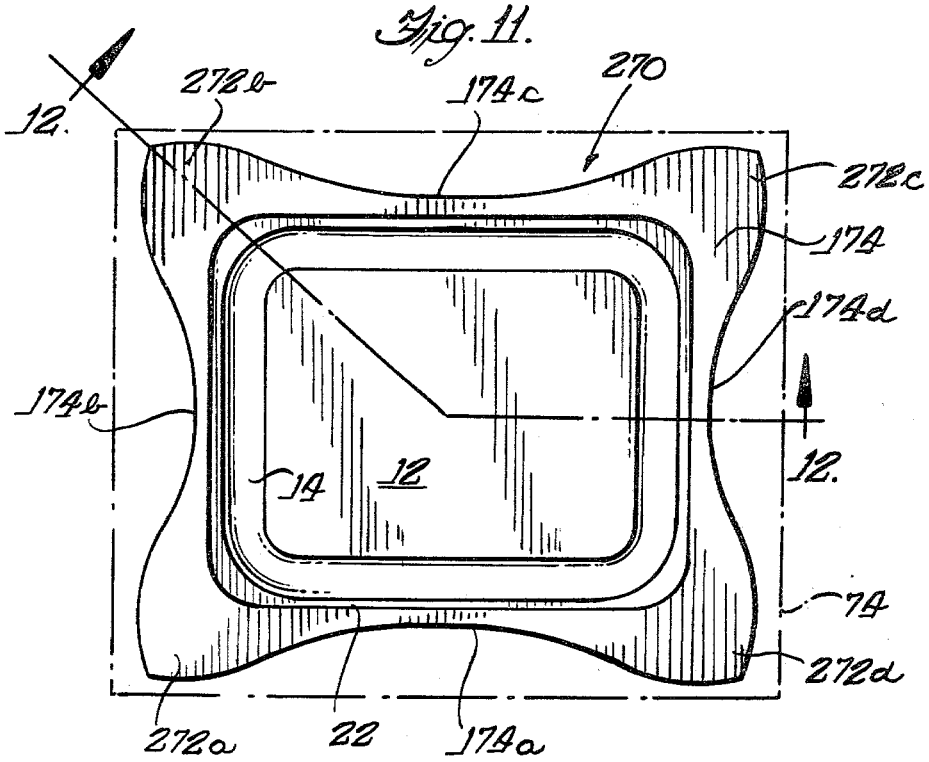
Figure 12:
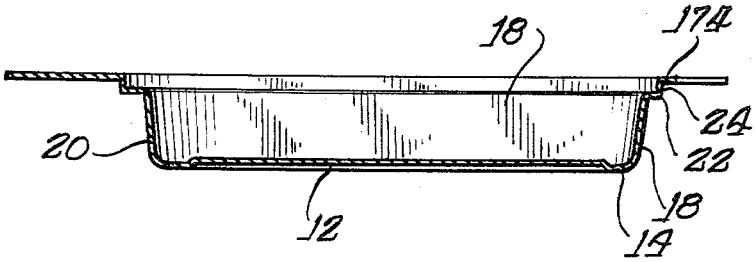

FIG. 5*a* is an enlarged detail sectional view of the pan sidewall after the first draw step in accordance with FIG. 5;

FIG. 6 is a partial transverse sectional view similar to FIG. 2 but showing the die set elements in position after a second draw step in forming the untrimmed container pan of FIG. 11;

FIG. 6*a* is an enlarged detail sectional view of the pan sidewall after forming as in FIG. 6;

FIG. 7 is a transverse sectional view, taken substantially along the line 7—7 of FIG. 8 looking in the direction of the arrows, showing apparatus for trimming the untrimmed pan and forming denesting protuberances thereon after the pan is formed as in FIG. 6;

FIG. 7*a* is an enlarged detail sectional view of the pan after trimming;

FIG. 8 is a plan view of the lower portion of the apparatus of FIG. 7;

FIG. 9 is a partial sectional view taken substantially along the line 9—9 of FIG. 8 and looking in the direction of the arrows;

FIG. 9*a* is an enlarged detail sectional view of the container pan showing a denesting protuberance formed thereon;

FIG. 10 is a partial plan view of the upper portion of the apparatus of FIG. 7, looking upwardly from the lower surface thereof;

FIG. 11 is a plan view of the untrimmed container pan after forming with the apparatus illustrated in FIGS. 3 and 4, the blank from which the untrimmed pan is formed being outlined in phantom; and FIG. 12 is a sectional view taken substantially along the line 12—12 of FIG. 11, looking in the direction of the arrows.

Figure 1:
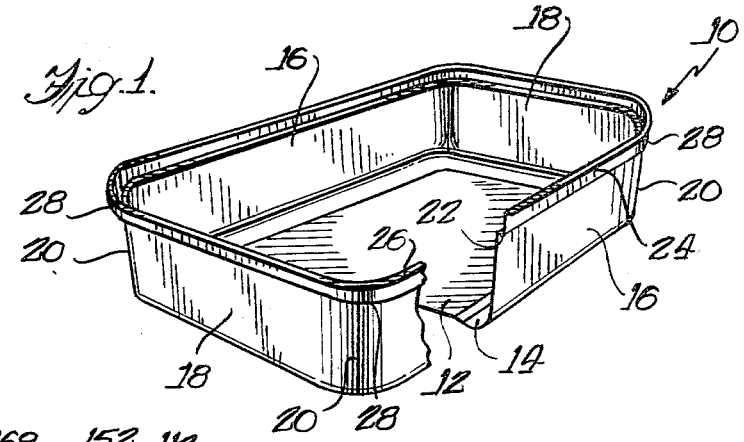
FIG. 1 is a perspective view of a container pan formed in accordance with the present invention, a portion being broken away for clarity.

Referring now to the drawings, and in particular to FIG. 1, a rectangular container pan formed in accordance with the present invention is indicated generally at 10. The container pan 10 is adapted to form the lower pan portion of a rectangular container which is particularly suitable for packaging food products and the like and is particularly suitable for institutional use where the food products may be packaged in the container pan, a lid (not shown) secured thereon by a double seam or by heat sealing, and the food product processed as by retorting within the container from which the processed food product may be served. The container pan 10 includes a bottom 12 the peripheral marginal edge of which is formed into a downwardly concave trough 14. The container pan includes upstanding side walls in the form of longitudinally extending walls 16 and transverse end walls 18. The upstanding side walls 16 and 18 are inclined outwardly from planes perpendicular to the bottom surface 12 and are interconnected through smooth radially rounded corner walls as shown at 20. Because the side walls 16 and 18 taper outwardly toward their upper edges, it will be appreciated that the radius of curvature of the corner walls 20 will be smaller at the lower ends of the corner walls than at their upper edges.

The upper edges of the side walls 16 and 18 and the corner walls 20 terminate in an outwardly directed shelf or step 22 which lies in a plane parallel to the plane of the bottom surface 12. Formed integral with the outer marginal edge of the shelf 22 is an upstanding rim wall or rise 24 which extends peripherally about the upper edge of the pan and is substantially perpendicular to the plane of the bottom surface 12. The upper edge of the peripheral rim 24 is formed with an outwardly directed flange or body hook 26 which extends about the full periphery of the upper edge of the pan and is adapted to have a lid (not shown) secured thereon by means of a double seam to hermetically seal the lid onto the pan. Stacking protuberances or denesting nibs 28 are formed at the outer corners of the shelf 22 to prevent telescoping of the pans 10 when stacked in nested relation.

The container pan 10 is particularly adapted for use in packaging food products and, with an associated lid secured thereon, is particularly suited for food products which might be termed "loose" or "flowable" food products, such as macaroni and cheese, chili and the like, or "layable" food products such as lasagne. One embodiment of the container pan 10 which finds particular application in institutional use has a longitudinal length of approximately 12 inches, a transverse width of approximately 10 inches, and a vertical depth of approximately 2¼ inches. The vertical height of the upper peripheral rim 24 is approximately 15/32 inch to facilitate removal of a lid secured thereon during preparation for serving the food product from the container pan. A container pan 10 having these dimensions will readily accommodate approximately 106 oz. net weight of food product. By increasing the depth of the pan to approximately 3¼ inches, the container pan capacity is increased to approximately 160 oz. net weight. Both the container pan 10 and the associated lid (not shown) may be made of suitable sheet metal stock, such as coated or noncoated steel or aluminum.

In accordance with the present invention, a method and apparatus for forming the container pan 10 are provided wherein the resulting container pan may be classed as a "rigid" container but has desirable flexibility characteristics which greatly enhance the ability of the container pan, and an associated lid secured thereon, to withstand internal and external pressures as may be encountered during processing of food products within the container pan and associated handling of the container pan during processing and subsequent serving of the food product.

The rectangular container pan 10 has a plan configuration size equal to approximately one-half the size of a conventional steam table opening so that a pair of the container pans may be supported in side-by-side relation within the steam table opening, the pans being supported by their shelf or step surfaces 22. The radius of curvature of the corners of the upstanding rim 24 is less than the radius of curvature of the lower corner walls 20 so that a minimum of open space exists between the table and a pan or between adjacent pans when disposed on a steam table, with a resultant minimal heat loss.

With reference to FIGS. 2–6, die set means for forming the container pan 10 in accordance with a preferred embodiment of the present invention are indicated generally at 30. The die set means 30 includes a lower die holder portion, indicated generally at 32, and an upper punch holder portion, indicated generally at 34. The lower die holder 32 and upper punch holder 34 are operatively associated, respectively, with a forming press having a vertically movable ram to which the upper punch holder 34 may be secured to facilitate movement of the upper punch holder toward and away from the lower die holder portion 32 of the die set means 30 as will become more apparent hereinbelow. The parts of the forming press not shown, such as the ram and auxiliary support members, may be of any desired configuration and, per se, do not form a part of the present invention.

The lower die holder portion 32 of the die set means 30 includes a manifold block 36 on which is secured a die shoe plate 38 as by screws 40. A retaining plate 42 is mounted on the die shoe plate 38 through a plurality of screws 44. A forming die or horn 48 is affixed to a riser block 50, as through screws 52 and locatingdowels 54 (FIG. 6). The riser block 50 is, in turn, affixed to the retaining plate 42 through locating dowels 56 and screws 58 received upwardly through the manifold block 36 and die shoe plate 38 as shown in FIG. 6. The forming die or horn 48 has an upper contoured surface 60 which establishes the interior surface configuration of the bottom 12 and inclined side walls 16 and 18 of the container 10 during forming thereof. The forming die 48 and associated riser block 50 have one or more upwardly extending air passages 62 formed therein through which air may be passed to assist in release of the formed container pan from the forming die 48 in a known manner.

A material support plate 64 is mounted on a riser yoke 66 through screws, as at 68 in FIG. 6. The riser yoke 66 is in turn affixed to the die plate 38 through screws such as indicated at 70 in FIG. 2. The material support plate 64 and riser yoke 66 extend peripherally of and are spaced outwardly from the riser block 50 and forming die 48, with the upper support surface 72 of the support plate 64 lying in a plane spaced slightly above the upper contoured surface 60 on the forming die 48. The upper surface 72 of the material support plate 64 is of sufficient area to support the peripheral edge portion of a blank of material, indicated at 74, which may comprise metallic sheet stock such as 80 lb. sheet steel, aluminum, or other suitable material, either coated or uncoated, from which the container pan 10 is formed. With a container pan 10 of the size above described, a blank 74 having dimensions of approximately $15 \times 17\frac{1}{8}$ inch size has been found suitable.

With the elements of the lower die holder 32 in their relative positions as shown in FIG. 2 preparatory to forming a container pan 10 from a metallic blank 74, the blank is also supported by an outer draw ring 76 and an inner draw ring 78 which extend peripherally about the forming die 48 concentric therewith. Both the outer draw ring 76 and the inner draw ring 78 are supported by a draw ring flange 80 which underlies the inner draw ring 78 and supports the outer draw ring 76 through a riser block 82. The draw ring flange 80 is secured to riser 82 and outer draw ring 76 through screws 83 as shown in FIG. 6. The draw ring flange 80 and the associated outer draw ring 76 and inner draw ring 78 are movable upwardly and downwardly relative to the drawing die 48 through piston means in the form of a plurality of pistons 84 which are spaced peripherally about the draw ring flange 80 in underlying relation therewith, as best shown in FIG. 3. The pistons 84 are received within cylinder sleeves 86 disposed within suitable bores within the die shoe plate 38 and manifold 36, each of the pistons 84 having a piston rod 88 which extends upwardly through the retaining plate 42 to engage the lower surface of the draw ring flange 80. The draw ring flange is limited in its upward movement by engagement with the lower surface of the material support plate 64.

The inner draw ring 78 has a flange 92 secured to its lower end which limits the extent of downward movement of the inner draw ring through engagement with the retaining plate 42 as will become more apparent hereinbelow. The outer draw ring flange 80 and flange 92 have complementary scallop-like surfaces, as shown at 94 in FIG. 3, to facilitate relative movement therebetween.

With reference to FIGS. 2 and 3, the pistons 84 are disposed about the periphery of the forming die 48 in engagement with the draw ring flange 80 so as to constitute 12 side pistons, indicated at **84*a* in FIG. 3, three of which are disposed along each side of the generally rectangularly shaped forming die 48 and are operative in forming the side walls 16 and 18 of the container pan 10 as will be described more fully below. One of the pistons 84 is disposed to underlie the outer draw ring 76 adjacent each corner of the forming die 48, such corner pistons being designated at 84*b* in FIG. 3**.

The manifold 36 is provided with suitable fluid flow passages to facilitate introduction of fluid pressure into the cylinders associated with each of the pistons 84, the fluid flow passages being such as to allow the pistons **84*b* associated with the corners of the outer draw ring 76 to be selectively subjected to a different fluid pressure than the pistons 84*a* associated with the portions of the draw ring 76 which form the side walls of the container pan 10. To this end, and with reference to FIG. 3, the manifold 36 includes a pair of transverse flow passages 96 and 98, the flow passage 96 being in fluid flow communication with a control valve 100 connected to a suitable source of fluid pressure, such as a hydraulic pump (not shown). The transverse flow passage 98 is in fluid communication with a control valve 102 which is also connected to a suitable source of fluid pressure such as a hydraulic pump (not shown). The transverse flow passage 96 is also in fluid pressure communication with a plurality of longitudinally extending flow passages 104*a*, 104*b*, 104*c*, 104*d* and 104*e* which are in fluid pressure communication with the pistons 84*a* so as to subject the pistons 84*a* to selective control pressure. The transverse flow passage 98 is in fluid pressure communication with a pair of flow passages 106*a* and 106*b* which are in fluid pressure communication with the corner pistons 84*b* to allow selective pressure control of the pistons 84*b*. It can be seen that by controlling the fluid pressure to the pistons 84, the vertical positions of the outer draw ring 76 and inner draw ring 78 relative to the forming die 48** may be selectively controlled.

With reference to FIGS. 2, 4, 5 and 6, the upper punch holder 34 includes an upper manifold 112 which is secured to the lower end of a vertically movable ram (not shown) of a forming press operatively controllable to move the upper punch holder 34 downwardly to a predetermined position relative to the lower die holder portion 32 of the die set means 30. The manifold 112 suitably supports a punch holder plate 114 for movement therewith. The punch holder plate 114 is maintained in predetermined vertical alignment with the lower die shoe plate 38 by means of a plurality of guide shafts such as indicated at 116 in FIG. 3. Preferably four guide shafts 116 are provided, each guide shaft being fixedly secured at its upper end to the punch holder plate 114 and extending downwardly through a suitable guide sleeve 118 secured on lower die shoe plate 38, the lower die shoe plate having suitable openings therein in alignment with the guide sleeves 118 to allow downward movement of the guide shafts 116 therethrough.

An upper retaining plate 120 is secured to the lower surface of the punch holder plate 114 by screws 122 (FIG. 2) which also serve to mount a riser member 124 against the retaining plate 120. A punch die or cap 126 is secured to the lower surface of the riser 124 as by screws 128 (FIG. 6) and locating dowels 130 (FIG. 5). The riser 124 and punch die 126 extend peripherally of a draw die pad 132 which is slidable along internal surfaces **124*a* and 126*a* of the riser and punch die, respectively, and is supported on the retaining plate 120 through a plurality of cap screws, one of which is indicated at 134 in FIG. 5. A coil compression spring 136 is disposed about each of the cap screws 134 between the retaining plate 120 and head portions 134*a* of the screws to bias the draw die pad 132 to an upper position toward the retaining plate 120. A circular knock-out plate 140 is received within a circular recess 142 within the draw die pad 132 and is biased to a position within the recess 142 by a plurality of compression springs 144 (FIG. 6) disposed between the heads of screws 146 and the draw die pad 132**.

A pair of pistons 148 are axially slidable within cylindrical piston bores formed in the manifold 112 and punch holder 114 and have piston rods 150 which extend through suitable openings in the retaining plate 120 and draw die pad 132 for engagement with the upper surface of the knock-out plate 140. The pistons 148 are in fluid pressure communication with a source of fluid pressure (not shown) through a fluid pressure passage 152 in the manifold 112 to facilitate movement of the knock-out plate 140 from the draw die pad 132 as will become more apparent hereinbelow.

The draw die pad 132 has an inner contoured surface 156 which is substantially identical to the contoured surface 60 on the forming die 48 of the lower die holder 32, the contoured surfaces 60 and 156 cooperating to form the bottom 12, peripheral trough 14 and side walls 16 and 18 of the container pan 10 during operation of the die set means 30. Sufficient clearance is provided between the complementary die surfaces to receive the thickness of the metallic blank 34 between the dies 48 and 132 during the forming operation.

With continued reference to FIGS. 2, 4, 5 and 6, the manifold 112 and punch holder plate 114 support a plurality of pistons 160 each of which is selectively axially movable in a cylindrical sleeve 162 received within suitable bores in the manifold and punch holder plate. As shown in FIG. 4, 12 pistons 160 are circumferentially spaced about and overlie the peripheral edge of the draw die pad 132, each piston having a piston rod 164 received through a suitable opening in the retaining plate 120 and engaging the upper surface of the draw die pad adjacent its peripheral edge. The pistons 160 are in common fluid pressure communication with a source of fluid pressure (not shown) through a control valve 166 which, in the illustrated embodiment, is mounted on the manifold 34 as shown in FIG. 4. The manifold 112 has a plurality of fluid flow passages 168*a*, 168*b*, 168*c* and 168*d* which communicate with the pistons 160 and allow selective control thereof through the valve 166. In the position of the elements of the upper punch holder die 34 as shown in FIG. 2, the pistons 160 are disposed in their lowermost positions relative to the punch holder plate 114 in which positions the draw die pad 132 is positioned such that a clamping edge surface 132*a* thereon is coplanar with a clamping surface 126*b* on the punch die 126.

In forming a container pan 10 from a blank 74, and with the elements of the lower die holder portion 32 and upper punch holder 34 of the die set means 30 disposed as shown in FIG. 2, the upper punch holder 34 is moved downwardly to a position wherein the blank 74 is clamped between clamping surfaces 76*a* and 126*b* on the outer draw ring 76 and punch die 126, respectively, and between the opposed clamping surfaces 78*a* and 132*a* on the inner draw ring 78 and draw die pad 132, respectively. If desired, a stripper plate (not shown) may be carried by the punch holder plate 114 for engagement with the blank 74 peripherally of the punch die 126 in a known manner.

Fluid pressure is supplied to the pistons 84 supporting the outer draw ring 76 and inner draw ring 78 such that continued downward movement of the punch holder plate 114 relative to the lower die holder 32 will effect shearing or punching of the blank 74 by cooperation of the lower outer peripheral edge 126*c* on die 126 with the support plate 64 and will simultaneously begin to move the outer draw ring 76 and inner draw ring 78 downwardly. During downward movement of the punch die 126 and draw die pad 132 against the blank 74 after shearing, the peripheral edge of the blank is drawn between the pairs of clamping surfaces 76*a*, 126*b*, and 78*a* and 126*a*, respectively, with the drawn peripheral edge of the blank being formed between the forming die 48 and the draw die pad 132. Movement of the upper punch holder plate 114 toward the lower die holder 32 to the position as shown in FIG. 5 wherein the draw die pad 132 forms the blank against the contoured surface 60 on the forming die 48, establishes the bottom 12, trough 14 and side walls 16 and 18 of the container pan 10. At this time, the flange 92 on the inner draw ring 78 is bottomed against the retainer plate 42 so that further downward movement of the inner draw ring is prevented.

The relative movement of the elements of the lower die holder 32 and upper punch holder 34 to their positions as shown in FIG. 5 constitutes a first draw of the blank 74 in forming the container pan 10 to the configuration as shown in FIG. 5*a*. In the described embodiment, the fluid pressure acting against the pistons 84*a* underlying the portions of the outer draw ring 76 which form the side walls 16 and 18 of the container pan is higher during the first draw than the pressure applied against the pistons 84*b* disposed at the four corners of the draw ring 76. For example, the pistons 84*a* may be subjected to a fluid pressure of approximately 2,000 psi while the pressure supplied to the corner pistons 84*b* is approximately 600 psi. These pressures and their relative pressure differential may vary depending upon the characteristics of the metallic blank 74 from which the pan 10 is formed.

After forming the blank 74 to the configuration as shown in FIG. 5*a*, the upper punch holder plate 114 is moved further downwardly relative to the lower die holder 32 to the position shown in FIG. 6. During this latter movement of the upper and lower die portions, termed the second draw, the peripheral edge of the blank 74 which is still clamped between the outer draw ring 76 and the upper punch die 126 is drawn through the clamping surfaces 76*a* and 126*b*, respectively, to establish the lateral width of the shelf 22 and form the upstanding rim or rise 24 on the container pan 10, it being understood that sufficient clearance is provided between the inner peripheral surface 126*a* of the punch die 126 and the outer surface 78*b* on the inner draw ring 78 to facilitate forming of the rise 24 on the container pan.

During the second draw in which the blank 74 is formed into a configuration as illustrated in FIG. 6*a*, the pressure acting on the pistons 84*a* is maintained at the same pressure as during the first draw. The pressure acting on the pistons 84*b* disposed at the corners of the draw ring 76 is substantially reduced during the second draw. Preferably, the fluid passages 106 associated with the corner pistons 84*b* are vented to atmospheric pressure at the reservoir to theoretically reduce the pressure acting on the lower corner pistons to zero. In practice, however, a residual fluid pressure is maintained against the pistons 84*b* so that they are subjected to a pressure greater than zero during the second draw.

During the first draw, the fluid pressure acting against the upper pistons 160 is maintained at a value sufficient to maintain the clamping surface 132*a* of the draw die pad 132 coplanar with the clamping surface 126*b* on the punch die 126. During the second draw wherein the elements of the die set reach their positions as shown in FIG. 6, the pressure acting on the upper pistons 160 is overcome to allow upward movement of the draw die 132 relative to the upper retaining plate 120 as shown in FIG. 6.

After forming the blank 74 to the configuration as shown in FIG. 6*a*, the lower die holder 32 and upper punch holder 34 are opened to allow ejection of the untrimmed container pan. In the illustrated embodiment, the upper punch holder plate 114 is raised relative to the die shoe plate 38 so as to withdraw the upper punch die 126 and draw die 132 to positions raised higher than the relative positions of the lower die holder 32 and upper punch holder 34 as shown in FIG. 2. During upward movement of the upper punch holder 34, the pressure on the upper pistons 160 is vented so that there will not be a significant clamping pressure applied by the lower inner draw ring 78 and upper draw die 132 on the ledge surface 22 of the formed pan 32 which might tend to deform the stacker ledge 22.

After the upper punch holder plate 114 has been raised sufficiently above the lower die holder 32, the knock-out plate 140 is moved downwardly by means of the pistons 148 to eject the untrimmed container pan from the upper punch holder 34. Air bleed holes, such as shown at 172 in FIG. 6, are provided in the upper draw die 132 to facilitate separation of the untrimmed container pan from the draw die pad. Similarly, the air holes 62 in the forming die 48 and riser 50 facilitate separation of the untrimmed pan from the forming die 48.

After forming the blank 74 through the first and second draws as thus far described, the untrimmed pan has an outwardly directed planar flange 174 which has a plan configuration as shown in phantom in FIG. 3. It can be seen that the metallic blank 74 has undergone less reduction during forming of the corner walls 20 of the container pan than have the portions of the blank which are formed into the upstanding side walls 16 and 18. In accordance with the method and apparatus thus far described, the bottom 12 and upstanding side walls 16 and 18 of the formed container pan have thicknesses substantially equal to the original thickness of the metallic blank 74. By providing suitable differential pressure acting on the pistons **84*a* and 84*b* associated with the draw ring 76, and forming the side walls and corner walls of the container pan so that the pressure applied to the pistons 88*b* adjacent the formed corner walls of the container pan is selectively less than the pressure applied to the pistons 84*a*** forming the upstanding side walls of the pan, smooth radial corner wall surfaces are formed which are devoid of wrinkles, ripples or other undesirable surface irregularities as found in the known prior art rectangular drawn container pans.

After forming the container pan 10 to the configuration as shown in FIGS. 3 and **6*a*, the peripheral edge 174 is trimmed to form the flange 26 on the container pan. Simultaneously, stacking protuberances, which may be termed denesting nibs, are formed at the four corners of the container pan 10 generally in the plane of the outwardly directed shelf 22, as indicated at 28 in FIG. 1**.

With reference to FIGS. 7–10, apparatus for trimming the untrimmed container pan after forming as in FIG. **6*a*, and simultaneously forming the denesting nibs 28 thereon is indicated generally at 180. The trimming apparatus 180 includes a lower die plate 182 and an upper die plate 184 which are maintained in vertically aligned relation through four guide rods 186, the upper ends of which are affixed to the upper die plate 184 and the lower ends of which extend downwardly through guide sleeves 188 affixed within suitable bores in the lower die plate 182. A bearing cage 190 and associated bearings are retained within the guide sleeves 188 for engagement with the outer surfaces of the guide rods 186 to facilitate relative movement between the upper and lower die plates. The upper die plate between the upper and lower die plates. The upper die plate 184 may be affixed to the vertically movable ram of a forming press for upward and downward movement relative to the lower die plate 182** which may be affixed in stationary position on the forming press.

The lower die plate 182 supports a riser plate 192 upon which is mounted a punch die 194. A pilot plate 196 is supported on the punch die 194 and is aligned therewith by means of a locating dowel 198. The pilot plate 196 has a peripheral configuration adapted to receive an untrimmed container pan 10 thereon in inverted position such that the flange 174 (FIG. **6*a*) of the pan seats on an upper edge surface 194*a* peripherally of the pilot plate 196 as shown in FIG. 7. To effect trimming of the flange 174, the upper die plate 184 has a trim die 200 mounted thereon through a riser block 202. The trim die 200 has an inner shear or punch edge 200*a* which is adapted for cooperation with the punch die 194 during downward movement of the upper die plate 184 relative to the lower die plate 182 to effect shearing of the flange 174 so as to establish the lateral width of the flange 26 on the container pan, as seen in FIG. 7*a***.

To retain the inverted pan 10 against the pilot plate 196 during trimming, a pad member 206 is mounted on the upper die plate 184 through a flange plate 208, the pad 206 being secured to the peripheral edge of the flange plate 208 by a plurality of screws 210. Four support screws 212, one at each corner of the flange plate 208, serve to mount the flange plate 208 on the upper die plate 184 to allow relative movement of the flange plate and associated pad 206 relative to the trim die 200. A compression spring 214 is disposed about each of the support screws 212 to bias the flange plate and pad 206 to the position as shown in FIG. 7. When the upper die plate 184 is moved downwardly relative to the lower die plate 182 during a trimming operation, the pad 206 engages the inverted pan 10 peripherally of the shelf and rise surfaces 22 and 24, respectively, to maintain the pan firmly against the pilot plate 196 as the trim die 200 trims the flange 174. A scrap chopper pin 216 having an upper cutting edge may be mounted on the lower die plate 182 at each end of the punch die 194 so that its upper cutting edge cooperates with the lower surface of the trim die 200 during trimming to sever the waste trim and allow it to be readily removed from the apparatus 180 without having to raise the waste trim vertically over the punch die 194 for removal.

Simultaneously with trimming the flange 174 on the partially completed pan 10 as described, a stacking protuberance 28, which may alternatively be termed a denesting nib, is formed at each corner of the pan 10 at the intersection of the shelf surface 22 with the upstanding rim 24 as shown in FIG. **9*a*. For this purpose, an embossing blade 220 is supported at each corner of the pilot plate 196 on the lower die plate 182 as shown in FIG. 8. With reference to FIGS. 7, 8 and 9, each of the embossing blades 220 is secured to a blade holder 222 as through a screw 224. Each blade holder 222 is guided for longitudinal sliding movement on the pilot plate 196 by a slide block 226** having a suitable channel therein through which the blade holder is slidably received.

The blade holders 222 have L-shaped inner ends against which a biasing compression spring 228 acts to bias the associated embossing blade generally toward the center of the pilot plate 196. The inner ends of the blade holders 222 are biased against a cam block 230 which is received within suitable openings 196*a* and 194*b* formed centrally within the pilot plate 196 and riser plate 194, respectively. The cam block 230 is supported on a guide pin 232 for vertical movement relative to the pilot plate 196 and is biased downwardly within the openings 196*a* and 194*b* by a compression spring 234. The cam block 230 has four outer cam surfaces each of which is cooperative with one of the blade holders 222 and includes an upper cam surface 238 and a lower cam surface 240, as seen in FIGS. 7 and 9. When the cam block 230 is in its lower position abutting the riser plate 192, the inner ends of the blade holders 222 are disposed in inner positions against the cam surfaces 238. When the cam block 230 is raised sufficiently relative to the pilot plate 196, the blade holders 222 are moved longitudinally outwardly by the cam surfaces 240. The longitudinal lengths of the blade holders 222 and their associated embossing blades 220 are such that when the blade holders are engaged by the cam surfaces 238, the outer ends of the embossing blades 220 are disposed inwardly of the outer peripheral edge of the pilot plate 196. When the blade holders are engaged by the cam surfaces 240, the ends of the embossing blades project a predetermined distance outwardly from the peripheral edge of the pilot plate 196.

To effect controlled movement of the cam block 230 relative to the inner ends of the blade holders 222, a pair of control rods 242, FIGS. 8 and 9, are axially slidably received through suitable bores in the lower die plate 182 and riser plate 192 so as to be engageable with the lower surface of the cam block 230. The lower ends of the control rods 242 are secured to a support bar 244 which rests on a rocker block 246. The rocker block 246 is secured on one end of a cam lever 248 which is pivotally mounted on the lower die plate 182 through a pivot pin 250. As shown in FIG. 7, a compression spring 252 biases the cam lever 248 in a clockwise direction about the pivot pin 250, as considered in FIG. 7, and the end of the cam lever opposite the rocker block 246 is engageable by a push rod 254 carried by the upper die plate 184 and receivable through a suitable bore 256 in the lower die plate 182.

The push rod 254 is axially adjustable relative to the upper die plate 184 and is set at a predetermined length so that substantially simultaneously with trimming the flange 174 on the inverted container pan 10 disposed on the pilot plate 196, the push rod will engage the cam lever 248 and effect upward movement of the cam block 230 so as to effect outward movement of the embossing blades 220 through engagement with the cam surfaces 240. The pad member 206 is formed with a recess 258 at each corner thereof for cooperation with the outer end of an associated one of the embossing blades 220 to form a stacking protuberance 28 on the container pan 10 when the cam block 220 is moved to its upper position to extend the embossing blades 220.

One or more stop blocks 260 are preferably mounted on the lower die plate 182 to limit downward movement of the upper die plate 184 relative to the lower die plate and thus provide a safety stop for the apparatus 180. After completing trimming and embossing of the stacking protuberances 28 on the pan 10, the upper die plate is raised and the completed pan 10 removed therefrom.

FIG. 11 illustrates in plan view the untrimmed container pan after forming as aforedescribed with the lower die holder 32 and upper punch holder portion 34 of the die set means 30. The untrimmed container pan is indicated generally at 270 and includes the outwardly directed planar flange 174 the plan configuration of which indicates that the blank 74, outlined in phantom in FIG. 11, has undergone greater reduction intermediate the longitudinal and transverse marginal edges thereof, as indicated at 174*a*, 174*b*, 174*c* and 174*d*, than the reduction at the corners of the blank. As a result, the flange 174 has corner ears formed thereon, as indicated at 272*a*, 272*b*, 272*c* and 272*d*, which are of substantially greater area than the portions of the flange 174 intermediate the corner areas.

The planar configuration of the flange 174 is the result of greater reduction in the portions of the blank 174 which form the bottom 12 and side walls 16 and 18 of the untrimmed container 270 than the portions of the blank which form the corner walls 20. In one embodiment of the untrimmed container pan 70 drawn from a blank 74 having a longitudinal length edge dimension of $17\frac{1}{8}$ inches and a transverse width dimension of 15 inches, the dimension of the center longitudinal axis of the blank was reduced approximately 20% with formation of the untrimmed edge portions 174*b* and 174*d* of the untrimmed container, while the transverse axis, at the longitudinal center of the blank, underwent approximately 24% reduction in establishing the untrimmed container pan side edges 174*a* and 174*c*. The diagonal dimension of the blank 74 was reduced approximately 6% between the original blank 74 and the drawn untrimmed container pan 270.

By forming the untrimmed container pan 270 from the blank 74 as thus described, that is, by reducing the blank 74 less in the corner areas 272 *a–d* than at the portions of the blank which form the longitudinal and transverse side edges 174*a*, 174*c*, and 174*b*, 174*d*, respectively, the thickness of the material forming bottom 12 and side walls 16 and 18 of the drawn container pan remain substantially equal to the original thickness of the blank 74 from which the container pan is drawn, and smooth curved nonwrinkled corner walls 20 interconnecting the upstanding side walls 16 and 18 of the container pan are formed.

Having thus described a preferred embodiment of apparatus for forming the drawn intermediate stage untrimmed container pan 270 and the final trimmed container pan 10 having a bottom surface 12 and upstanding side walls 16 and 18 interconnected through smooth radially curved corner walls 20 the upper edges of which are formed with a horizontal shelf 22 and an upstanding peripheral rim 24, it will be appreciated that the pan is formed by clamping the peripheral surface of the blank 74 from which the pan 10 is formed between opposed clamping members 78, 132*a* and 76, 126, and effecting engagement of the blank with forming die means 48 and 132 during a first draw to draw the clamped blank between the clamping members while simultaneously forming the bottom, side walls and corner walls of the pan. A clamping force is applied to the clamping members simultaneously with forming of the bottom, side walls and corner walls, the clamping force applied to the blank at the portions thereof which form the corner walls of the pan being different than the clamping force applied to the portions of the blank which form the side walls. In the described embodiment, the clamping force applied to the portions of the blank which form the side walls is greater than the clamping force applied to the blank at the portions thereof which form the corner walls of the pan.

The upstanding peripheral rim 24 is formed integral with the shelf 22 during a second draw by drawing an additional portion of the blank 74 between clamping members, the clamping force applied to the portions of the blank which are drawn to form the corners of the rim 24 being reduced from the clamping force applied to the blank during drawing of the corner walls 20. During the second draw, the blank is drawn between the clamping surfaces 76*a* and 126*b*, the clamping surfaces 78*a* and 132*a* being stationary and establishing the shelf 22 on the pan 10. In releasing the drawn pan from the forming dies 48 and 132, the clamping force on the shelf 22 is made negligible so as to prevent wrinkling thereof. Depending on the initial configuration of the blank 74 from which the pan is drawn, it may be desirable to trim the pan to prepare the upper flange portion 26 thereon for purposes of securing a lid thereon. Simultaneously with trimming the pan, denesting protuberances 28 may be formed on the pan adjacent the corners thereof and substantially at the intersection of the rim 24 with the shelf 22.

While a preferred embodiment of the present invention has been illustrated and described, it will be understood by those skilled in the art that changes and modifications may be made therein without departing from the invention in its broader aspects. Various features of the invention are defined in the following claims.

What is claimed is:

1. Apparatus for forming a rectangular container pan having a bottom surface and upstanding side walls interconnected through smooth radially curved corner walls, said apparatus comprising, in combination, die set means including a lower die holder and an upper punch holder, said lower die holder having means for supporting a blank from which the container pan is formed, means including opposed fluid pressure operated clamping members adapted to clamp the full peripheral surface of said blank, forming die means carried by said lower die holder and said upper punch holder and cooperative to engage opposite surfaces of said blank and draw the clamped blank between said clamping members so as to simultaneously form the bottom and side and corner walls such that the side and corner walls are formed from portions of the blank drawn between said clamping members, and means for controlling the clamping force on the peripheral surface of the blank at the portions of said blank drawn to form said side and corner walls, said control means being operative during a first draw operation to establish a substantially constant clamping force on the portions of the blank forming the side walls during forming of said bottom and side and corner walls, said control means being operative to establish a substantially constant clamping force on the portions of the blank which form the corner walls of said pan which is less than the clamping force applied to the portions of the blank which form the side walls.

2. Apparatus as defined in claim 1 wherein said rectangular container pan has an outwardly directed peripheral shelf formed at the upper edges of said side and corner walls and a peripherally extending upstanding rim, and wherein said forming die means are operative to draw said blank between said clamping means for forming said upstanding rim during a second draw operation.

3. Apparatus as defined in claim 2 wherein said control means is operative to reduce the clamping force acting on the blank at the portions thereof which form the corners of said upstanding rim during said second draw while maintaining the clamping force acting on said blank at the portions thereof which form the side portions of said rim at substantially the same force as during said first draw operation.

4. Apparatus as defined in claim 1 wherein said fluid pressure actuating means comprises a plurality of fluid pressure operated pistons spaced circumferentially about at least one of said clamping members, each of said fluid pressure actuating pistons being in communication with fluid pressure source means, said control means being operative to selectively control the fluid pressure applied to said pistons.

5. Apparatus as defined in claim 1 wherein said forming die means includes a forming die carried by said lower die holder and an upper draw die carried by said upper punch holder, said forming die and upper draw die being supported for movement relative to each other, and including means for effecting said relative movement between said die member and said draw die member to form said bottom, side walls and corner walls of said pan during said first draw operation.

6. Apparatus as defined in claim 5 including fluid pressure actuating means operatively associated with said upper draw die and acting on the periphery thereof to facilitate control of said clamping force, and means for moving said upper draw die to a position spaced from said forming die, said control means including means operative to control the fluid pressure applied to said fluid pressure actuating means acting on said upper draw die so as to substantially reduce the pressure acting on said upper draw die after said second draw to facilitate movement of said upper draw die away from said forming die.

7. Apparatus as defined in claim 6 including a knockout plate carried by said upper draw die and operative to facilitate ejection of a formed pan from said upper draw die after forming said pan during said second draw operation.

* * * * *

UNITED STATES PATENT AND TRADEMARK OFFICE

CERTIFICATE OF CORRECTION

PATENT NO. : 4,309,888

DATED : January 12, 1982

INVENTOR(S) : Roland E. Miller, Joseph A. Scaletta, John Valek

It is certified that error appears in the above—identified patent and that said Letters Patent is hereby corrected as shown below:

Column 10, lines 2 and 3, delete the sentence reading ---The upper die plate between the upper and lower die plates.---

Signed and Sealed this

*First* Day of *June 1982*

[SEAL]

*Attest:*

GERALD J. MOSSINGHOFF

*Attesting Officer*

*Commissioner of Patents and Trademarks*